US006250062B1

(12) United States Patent
Lawen, Jr. et al.

(10) Patent No.: US 6,250,062 B1
(45) Date of Patent: Jun. 26, 2001

(54) FUEL NOZZLE CENTERING DEVICE AND METHOD FOR GAS TURBINE COMBUSTORS

(75) Inventors: James Louis Lawen, Jr., White, GA (US); Abdul-Azeez Mohammed-Fakir, Schenectady; Robert Harold Cromer, Johnstown, both of NY (US); Henry Joe Wiersma, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/376,171

(22) Filed: Aug. 17, 1999

(51) Int. Cl.[7] ..... F02C 1/00
(52) U.S. Cl. ..... 60/39.02; 60/740; 29/455.1
(58) Field of Search ..... 60/740, 748, 39.02; 29/455.1

(56) References Cited

U.S. PATENT DOCUMENTS 3,853,273 * 12/1974 Bahr et al. ..... 239/402
4,656,713 * 4/1987 Rosa et al. ..... 29/157 R
5,408,830 4/1995 Lovett ..... 60/737
5,471,840 12/1995 Lovett ..... 601/737
5,518,395 5/1996 Maughan ..... 431/8
5,676,538 10/1997 Lovett ..... 431/182

* cited by examiner

*Primary Examiner*—Charles G. Freay
*Assistant Examiner*—Ehud Gartenberg

(57) ABSTRACT

A fuel nozzle centering assembly and method employ bodies of a substantially wearable and sacrificial material mounted to an outer periphery of a tip of a burner fuel nozzle for a gas turbine combustor. The tip of the fuel nozzle extends through an opening of an annular collar attached to a liner of a main combustion chamber of the gas turbine combustor and an outer periphery of the tip is disposed radially inwardly from the annular collar such that the bodies of sacrificial material are disposed between the outer periphery of the fuel nozzle tip and the annular collar of the liner and space the fuel nozzle tip from the liner collar. The bodies of material prevent the fuel nozzle tip from contacting the liner collar during assembling of the fuel nozzle into the liner. The bodies wear away substantially upon initial operation of the combustor such that the bodies will reduce contact with the liner collar during further operation of the combustor and the fuel nozzle tip will remain spaced from and out of contact with the liner collar during operation of the combustor.

16 Claims, 5 Drawing Sheets

FUEL NOZZLE CENTERING DEVICE AND METHOD FOR GAS TURBINE COMBUSTORS

BACKGROUND OF THE INVENTION

The present invention generally relates to gas turbine combustors and, more particularly, is concerned with a fuel nozzle centering device and method for gas turbine combustors.

As depicted in FIGS. 1 to 3, a prior art gas turbine generally includes a combustor 10 having a main combustion chamber 12 and one or more burners 14 attached to the main combustion chamber 12. Compressed air enters the burner 14 from the left and flows to the right through the combustor 10. Air is provided by a compressor (not shown) and may be reversed flowed over the combustor 10 before entering the burner 14. While only one burner 14 is shown for clarity of illustration, a plurality of burners 14 is preferably used. Typically, five or six burners are arranged in a circular array on the main combustion chamber 12.

The main combustion chamber 12 includes a liner 16 having an upstream end 16A and an opening 18 defined in the liner 16 by an annular collar 20 attached to the upstream end 16A of the liner 16. The burner 14 typically includes a cylindrical flow tube (not shown) and a fuel nozzle 22 concentrically disposed within the flow tube. The fuel nozzle 22 includes a cylindrical hub 24, an annular flange 26 interconnected with and extending circumferentially around the hub 24, and a tip 28 interconnected with and disposed downstream from the hub 24. The fuel nozzle flange 26 defines a plurality of through-holes 30 which are circumferentially spaced apart from one another. The combustor 10 also includes a cover 32 and a plurality of bolts 34. The cover 32 has a plurality of holes 36 defined therein being alignable with the holes 30 of the fuel nozzle flange 26. The bolts 34 are inserted through the through-holes 30 of the fuel nozzle flange 26 and into the holes 36 of the cover 34 and thereby removably secure the fuel nozzle flange 26 and combustor cover 32 to one another. The fuel nozzle tip 28 has an outer periphery 38 where it is assembled into the liner collar 20.

Due to many stack-up tolerances involved in assembling fuel nozzles of burners into the liner of the main combustion chamber, fuel nozzle misalignment is commonplace and causes a redundancy in liner head end support by sharing the support load between the fuel nozzle and liner stops (not shown). Operational experience and analysis has shown that this type of system creates an environment where dynamics are higher and part wear is increased. In the current system, fuel nozzles are assembled into liner collars through a complex assembly of parts. To allow for the stack-up of tolerances, clearances between the parts, especially at the bolts, is necessary. Because of this, misalignment of the fuel nozzle often occurs.

Various devices and methods have been developed over the years toward providing a solution of the aforementioned problem of misalignment of the fuel nozzle. The primary devices and methods employed in the industry have been the use of floating liner collars 40, as shown in FIG. 2, and of a body bound arrangement, as shown in FIG. 3. The floating liner collar 40 makes up for fuel nozzle misalignment by allowing the liner collar to "float" through a predetermined clearance. While this device and method has been somewhat satisfactory, it is expensive due to its complexity and has been prone to create additional wear problems, particularly in the liner collar itself. The body bound arrangement usually replaces three of the bolt through-holes with tapered bolts 42 that attempt to center the fuel nozzle. After time, however, the bolts or holes become worn and the same misalignment problems arise. Further, due to its complexity, this design can be difficult and expensive for retrofit applications.

Consequently, a need still exists for an innovation which will provide a solution to the aforementioned problems in the prior art without introducing any new problems in place thereof.

SUMMARY OF THE INVENTION

The present invention provides a fuel nozzle centering device and method for gas turbine combustors designed to satisfy the aforementioned need. The fuel nozzle centering device and method alleviate fuel nozzle contact such that system dynamics are reduced, part wear is reduced and overall combustor life is extended.

In an exemplary embodiment of the present invention, a gas turbine combustor comprises a main combustor chamber having a liner and an annular collar mounted to the liner so as to define an opening therethrough, at least one burner attached to the main combustor chamber and having a fuel nozzle mounted adjacent to the liner with a tip of the fuel nozzle disposed through the opening of the annular collar of the main combustor chamber and an outer periphery of the tip disposed within and adjacent to the annular collar, and a fuel nozzle centering device mounted to the tip of the fuel nozzle and disposed between the outer periphery of the fuel nozzle tip and the annular collar of the liner, the device including a sacrificial body of material contacting the liner collar and spacing the fuel nozzle tip radially inwardly from the liner collar such that the fuel nozzle tip is prevented from contacting the liner collar during assembling of the fuel nozzle of the burner to the liner of the main combustion chamber, the sacrificial body of material being at least partially wearable away upon initial operation of the gas turbine combustor such that the sacrificial body of material will diminish in quantity and thereby reduce contact with the liner collar during further operation of the gas turbine combustor so that the fuel nozzle tip will remain spaced from and substantially out of contact with the liner collar of the main combustion chamber during continued operation of the gas turbine combustor. The body of sacrificial material can have a substantially annular configuration and extend around the outer periphery of the fuel nozzle tip of the burner. The body of material may be in the form of a bead, tape or a wire. The device can include a plurality of bodies of the material having substantially the same sizes and being are spaced apart such as at equal distances from one another.

In another exemplary embodiment of the present invention, a method for centering a fuel nozzle of a burner in a gas turbine combustor comprises the steps of providing at least one and, preferably, a plurality of bodies of a substantially wearable and sacrificial material, mounting the bodies to an outer periphery of a tip of a fuel nozzle of a burner for a gas turbine combustor, assembling the fuel nozzle with its tip extending through an opening of an annular collar attached to a liner of a main combustion chamber of the combustor, and preventing the fuel nozzle tip of the burner from coming into contact with the liner collar of the main combustion chamber during the assembling step by the bodies contacting the liner collar of the main combustion chamber and spacing the fuel nozzle tip of the burner from the liner collar. The method further comprises the step of wearing away the bodies at least partially and, preferably, substantially upon initial operation of the gas turbine combustor such that the bodies will reduce contact with the liner collar of the main combustion chamber during further operation of the combustor and the fuel nozzle tip of the burner will remain spaced from and out of contact with the liner collar of the main combustion chamber during operation of the combustor.

These and other features and advantages of the present invention will become apparent to those skilled in the art upon a reading of the following detailed description when taken in conjunction with the drawings wherein there is shown and described an illustrative embodiment of the invention.

DETAILED DESCRIPTION OF THE INVENTION

Figure 1:
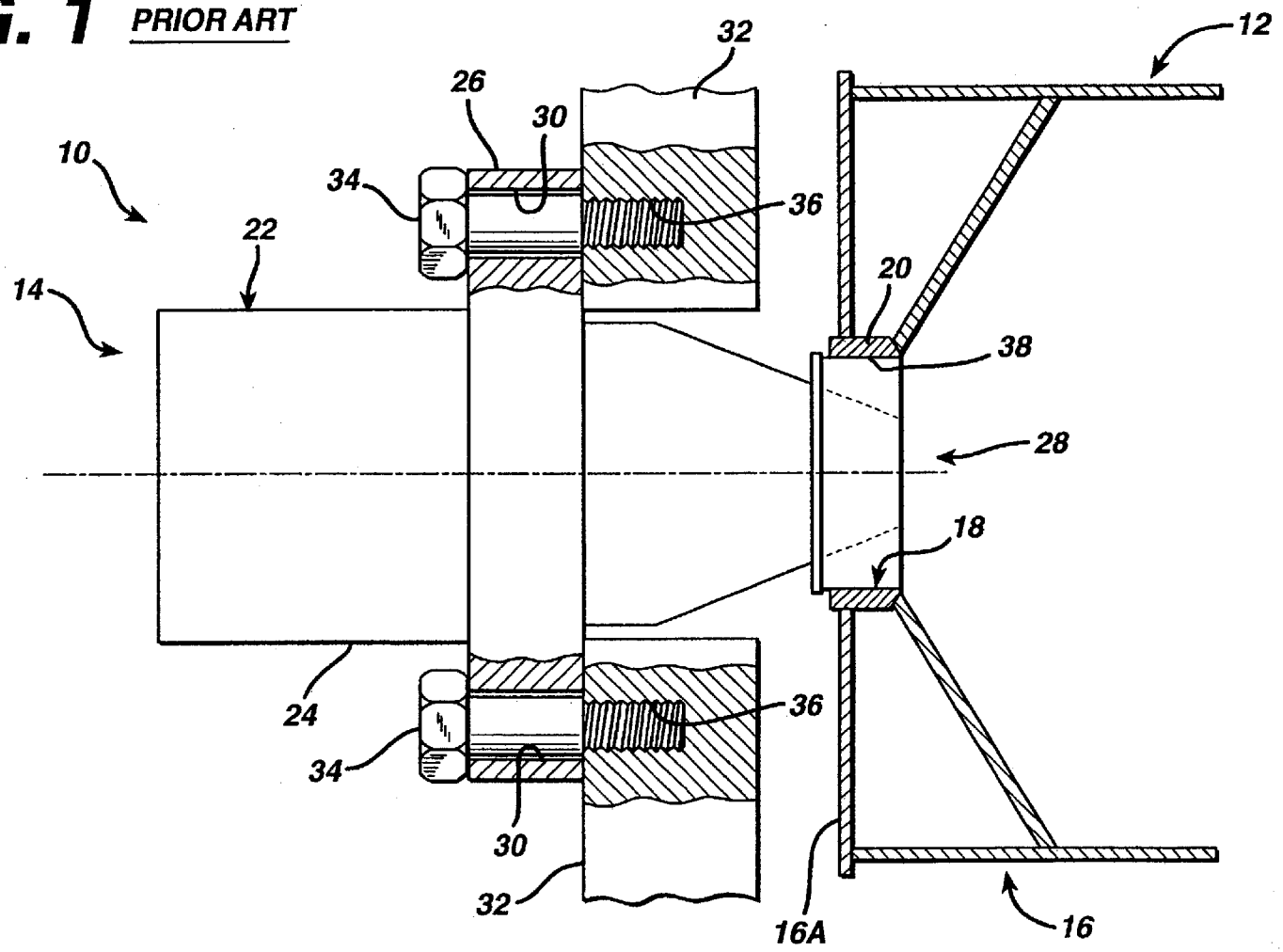
FIG. 1 PRIOR ART
FIG. 1 is a schematic fragmentary longitudinal sectional view of a prior art gas turbine combustor showing one prior art arrangement wherein a tip of a fuel nozzle of a burner is assembled into a collar of a liner of a main combustion chamber of the prior art combustor.
Figure 2:
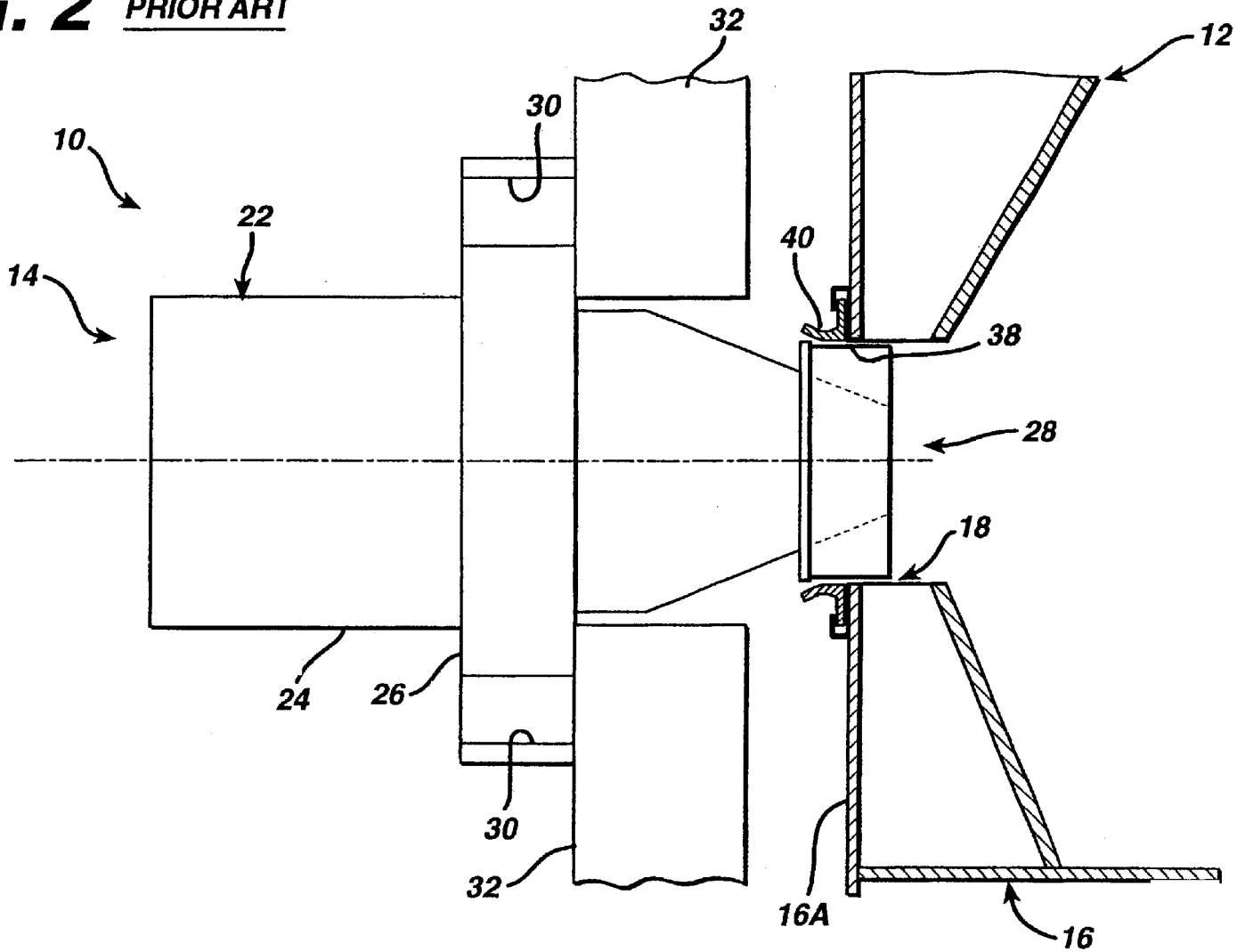
FIG. 2 PRIOR ART
FIG. 2 is a schematic fragmentary longitudinal sectional view of the prior art gas turbine combustor generally similar to that of FIG. 1 but showing another prior art arrangement wherein a floating collar is disposed between the fuel nozzle tip of the burner and the main combustion chamber liner of the prior art combustor.
Figure 3:
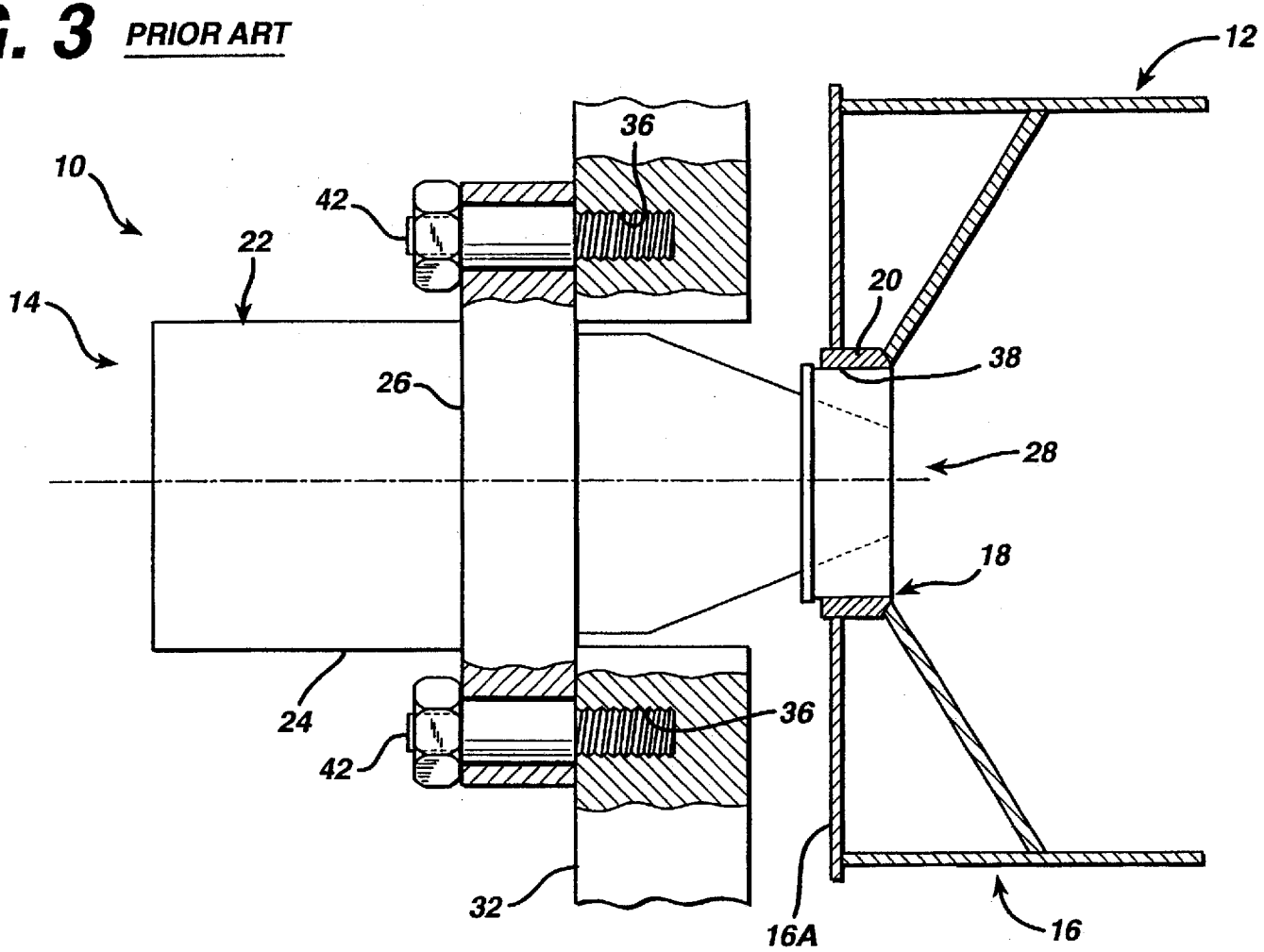
FIG. 3 PRIOR ART
FIG. 3 is a schematic fragmentary longitudinal sectional view of the prior art gas turbine combustor generally similar to that of FIG. 1 but showing still another prior art arrangement wherein bolt through holes of the prior art combustor shown in FIG. 1 are replaced with tapered bolts.
Figure 4:
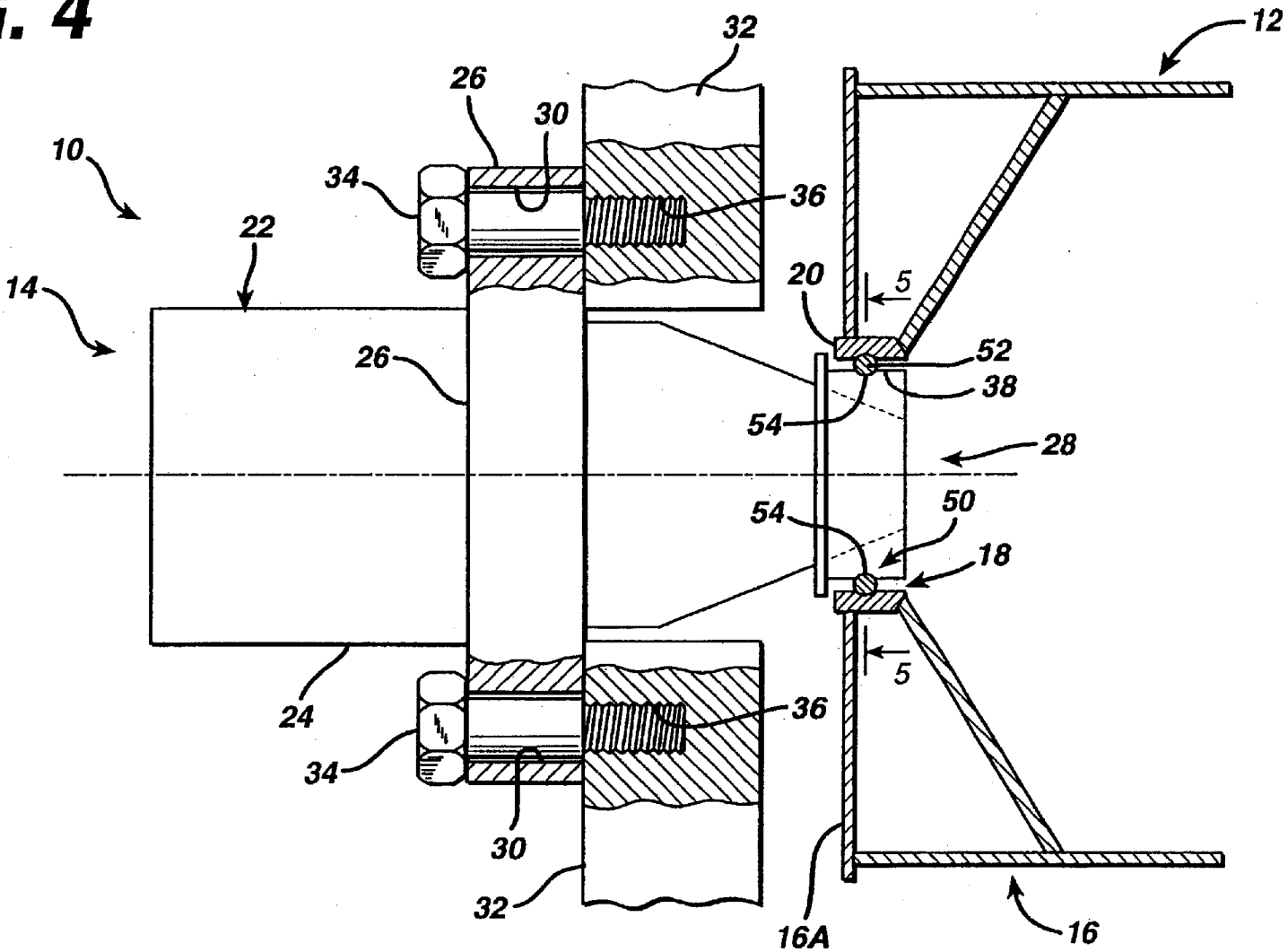
FIG. 4 is a schematic fragmentary longitudinal sectional view of the prior art gas turbine combustor generally similar to that of FIG. 1 but showing a first exemplary embodiment of a fuel nozzle centering device of the present invention disposed between the fuel nozzle tip of the burner and the liner collar of the main combustion chamber of the prior art combustor.
Figure 5:
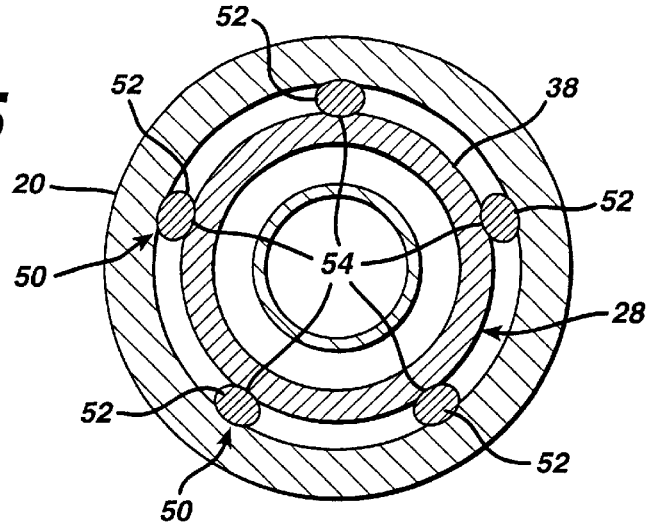
FIG. 5 is an enlarged schematic cross-sectional view of the fuel nozzle centering device taken along line 5—5 of FIG. 4.

Referring to the drawings and particularly to FIGS. 4 and 5, there is illustrated a fuel nozzle centering device, generally designated 50, of the present invention used in the prior art gas turbine combustor 10 of FIG. 1. The fuel nozzle centering assembly 50 basically includes at least one and, preferably, a plurality of bodies 52 made of a substantially wearable and sacrificial material. The material of each body 52 may be plastic or any other suitable material.

The bodies 52 are mounted to the outer periphery 38 of the fuel nozzle tip 28 of each burner 14 for the gas turbine combustor 10. In view that the tip 28 of the fuel nozzle 22 extends through the opening 18 of the annular collar 20 attached to the combustion chamber liner 16 and is disposed radially inwardly therefrom, the bodies 52 are disposed between the annular collar 20 of the liner 16 and the outer periphery 38 of the fuel nozzle tip 28 and space the fuel nozzle tip 28 from the liner collar 20.

The bodies 52 of sacrificial material will prevent the fuel nozzle tip 28 from contacting the liner collar 20 during assembling of the fuel nozzle 22 into the liner 16. The bodies 52 will wear away at least partially, and preferably substantially, upon initial operation of the combustor 10 such that the bodies 52 will reduce contact with the liner collar 20 during further operation of the combustor 10 and the fuel nozzle tip 28 will remain spaced from and out of contact with the liner collar 20 during operation of the combustor 10. The immediate wearing away of the bodies 52 upon operation of the combustor 10 is desirable to achieve an optimum level of performance of the device 50. The immediate wearing away may occur as melting or any other suitable type of disintegration of the bodies 52 to achieve removal of the bodies 52 from the fuel nozzle tip 28 of the burner 14.

Figure 6:
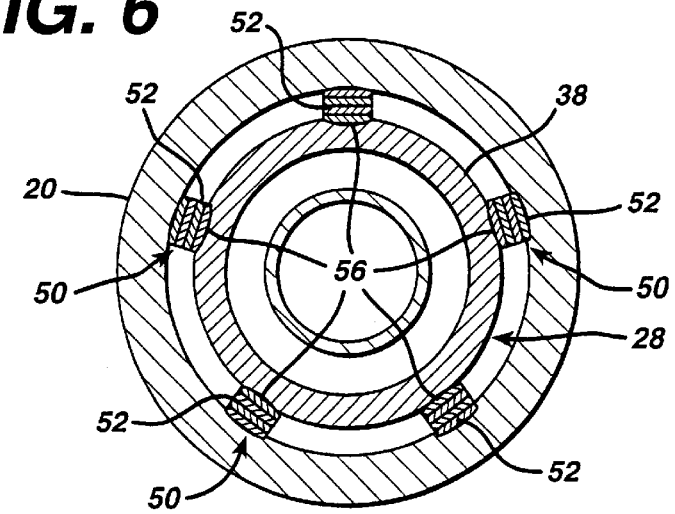
FIG. 6 is a schematic cross-sectional view similar to that of FIG. 5 but showing a second exemplary embodiment of the fuel nozzle centering device of the present invention.
Figure 7:
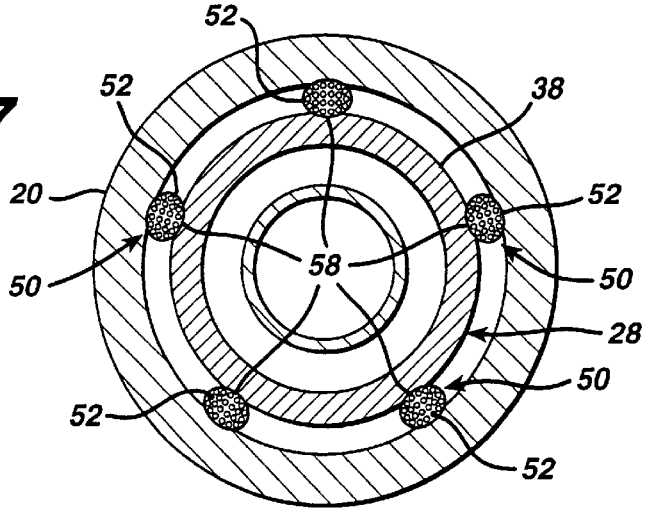
FIG. 7 is a schematic cross-sectional view similar to that of FIG. 6 but showing a third exemplary embodiment of the fuel nozzle centering device of the present invention.

If only one body 52 is provided, it may have a substantially annular configuration and extend around the outer periphery 38 of the fuel nozzle tip 28 of the burner 14, as shown in FIGS. 4 and 5. The one body 52 may be in the form of a brazed bead 54 as seen in FIGS. 4 and 5, or a brazed tape 56 as seen in FIG. 6, or a wire 58 as seen in FIG. 7. If a plurality of bodies 52 are provided, as is preferred, they are spaced apart from one another and, preferably, are spaced equal distances apart from one another, as shown in FIGS. 5 to 7. The bodies 52 can number six or are of any other suitable number. Each of the bodies 52 may also be in the form of the brazed bead 54, tape 56 or wire 58. The bodies 52 preferably have substantially the same sizes, but need not be so limited.

The device 50 is a temporary solution which allows the fuel nozzle flange 26 of the burner 14 to be bolted to the combustor cover 34 so as to maintain a centered assembly in the process. The bodies 52 of the device 50 will wear away to achieve substantial disintegration thereof such that any contact between the fuel nozzle tip 28 of the burner 14 and the liner collar 20 of the main combustion chamber 12 is very limited in duration or nonexistent during steady state operation of the gas turbine.

The method for centering the fuel nozzle 22 of the burner 14 of the gas turbine combustor 10 includes the steps of providing at least one and, preferably, the plurality of bodies 52 made of the substantially wearable and sacrificial material, mounting the bodies 52 to the outer periphery 38 of the tip 28 of the fuel nozzle 22 of the burner 14 for the gas turbine combustor 10, assembling the fuel nozzle 22 of the burner 14 into the liner 16 of the main combustion chamber 12 of the combustor 10, and preventing the fuel nozzle tip 28 of the burner 14 from coming into contact with the collar 20 of the liner 16 of the main combustion chamber 12 during the assembling step by the bodies 52 contacting the liner collar 20 of the main combustion chamber 12 and spacing the fuel nozzle tip 28 of the burner 14 from the liner collar 20 of the main combustion chamber 12. The fuel nozzle centering method also includes the step of wearing away the bodies 52 at least partially and, preferably, substantially upon initial operation of the gas turbine combustor 10 such that the bodies 52 will reduce contact with the liner collar 20 of the main combustion chamber 12 during further operation of the combustor 10 and the fuel nozzle tip 28 of the burner 14 will remain spaced from and out of contact with the liner collar 20 of the main combustion chamber 12 during operation of the combustor 10.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

What is claimed is:

1. A gas turbine combustor, comprising:

a main combustor chamber having a liner and an annular collar mounted to said liner so as to define an opening therethrough;

at least one burner attached to said main combustor chamber and having a fuel nozzle mounted adjacent to said liner and a tip of said fuel nozzle disposed through said opening of said annular collar of said main combustor chamber with an outer periphery of said tip disposed within and adjacent to said annular collar; and a fuel nozzle centering device mounted to said outer periphery of said tip of said fuel nozzle and disposed between said outer periphery of said fuel nozzle tip and said annular collar of said liner, said device including a sacrificial body of material contacting said liner collar and spacing said fuel nozzle tip radially inwardly from said liner collar such that said fuel nozzle tip is prevented from contacting said liner collar during assembling of said fuel nozzle of said burner to said liner of said main combustion chamber, said sacrificial body of material being at least partially wearable away upon initial operation of said gas turbine combustor such that said sacrificial body of material will diminish in quantity and thereby reduce contact with said liner collar during further operation of said gas turbine combustor so that said fuel nozzle tip will remain spaced from and substantially out of contact with said liner collar of said main combustion chamber during continued operation of said gas turbine combustor.

2. The combustor of claim 1 in which said body of sacrificial material has a substantially annular configuration and extends around said outer periphery of said fuel nozzle tip of said burner.

3. The combustor of claim 1 in which said body of sacrificial material is in the form of a bead.

4. The combustor of claim 1 in which said body of sacrificial material is in the form of tape.

5. The combustor of claim 1 in which said body of sacrificial material is in the form of a wire.

6. A gas turbine combustor, comprising:

a main combustor chamber having a liner with an upstream end and an annular collar mounted to said upstream end of said liner so as to define an opening therethrough;

at least one burner attached to said main combustor chamber and having a fuel nozzle mounted adjacent to said upstream end of said liner, said fuel nozzle having a tip disposed through said opening of said annular collar of said main combustor chamber with an outer periphery of said tip disposed within and adjacent to said annular collar; and a fuel nozzle centering device mounted to said outer periphery of said tip of said fuel nozzle of said burner and disposed between said outer periphery of said fuel nozzle tip and said annular collar of said liner, said fuel nozzle centering device including a plurality of sacrificial bodies of material contacting said collar of said liner and spacing said fuel nozzle tip radially inwardly from said liner collar such that said fuel nozzle tip is prevented from contacting said liner collar of said main combustion chamber during assembling of said fuel nozzle of said burner to said liner of said main combustion chamber, said sacrificial bodies of material being at least partially wearable away upon initial operation of said gas turbine combustor such that said sacrificial bodies of material will diminish in quantity and reduce contact with said liner collar during further operation of said gas turbine combustor so that said fuel nozzle tip will remain spaced from and out of contact with said liner collar of said main combustion chamber during continued operation of said gas turbine combustor.

7. The combustor of claim 6 in which said bodies have substantially the same sizes.

8. The combustor of claim 6 in which said bodies are spaced apart from one another.

9. The combustor of claim 6 in which said bodies are spaced apart equal distances from one another.

10. The combustor of claim 6 in which each of said bodies is in the form of a bead.

11. The combustor of claim 6 in which each of said bodies is in the form of tape.

12. The combustor of claim 6 in which each of said bodies is in the form of a wire.

13. A method for centering a fuel nozzle of a burner in a gas turbine combustor, the method comprising the steps of:

providing at least one body of a substantially wearable and sacrificial material;

mounting the body to an outer periphery of a tip of a fuel nozzle of a burner for a gas turbine combustor;

assembling the fuel nozzle of the burner to a liner of a main combustion chamber of the gas turbine combustor with the tip of the fuel nozzle extending through an opening of an annular collar attached to the liner; and preventing the fuel nozzle tip of the burner from coming into contact with the annular collar of the liner of the main combustion chamber during the assembling step by the body of sacrificial material contacting the liner collar of the main combustion chamber and spacing the fuel nozzle tip of the burner from the liner collar.

14. The method of claim 13 in which the providing step includes providing a plurality of bodies of a substantially wearable and sacrificial material.

15. The method of claim 14 further comprising the step of:

wearing away the bodies at least partially upon initial operation of the gas turbine combustor such that the bodies will reduce contact with the liner collar of the main combustion chamber during further operation of the gas turbine combustor while the fuel nozzle tip of the burner will remain spaced from and out of contact with the liner collar of the main combustion chamber during operation of the gas turbine combustor.

16. The method of claim 13 further comprising the step of:

wearing away the body at least partially upon initial operation of the gas turbine combustor such that the body will reduce contact with the liner collar of the main combustion chamber during further operation of the gas turbine combustor while the fuel nozzle tip of the burner will remain spaced from and out of contact with the liner collar of the main combustion chamber during operation of the gas turbine combustor.

* * * * *